US008141632B2

(12) United States Patent
Maksimenko et al.

(10) Patent No.: US 8,141,632 B2
(45) Date of Patent: Mar. 27, 2012

(54) METHOD FOR HYDRAULIC FRACTURE DIMENSIONS DETERMINATION

(75) Inventors: Anton Aleksandrovich Maksimenko, Moscow (RU); Marc Jean Thiercelin, Ville d'Avray (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 1 day.

(21) Appl. No.: 12/302,399

(22) PCT Filed: May 29, 2007

(86) PCT No.: PCT/RU2007/000272

§ 371 (c)(1), (2), (4) Date: Feb. 20, 2009

(87) PCT Pub. No.: WO2007/139448

PCT Pub. Date: Dec. 6, 2007

(65) Prior Publication Data

US 2009/0166029 A1 Jul. 2, 2009

(30) Foreign Application Priority Data

May 31, 2006 (RU) ..... 2006118852

(51) Int. Cl.
*E21B 49/00* (2006.01)

(52) U.S. Cl. ..... 166/250.1; 703/10

(58) Field of Classification Search ..... 166/250.1, 166/280, 281; 703/10; 702/12, 13
See application file for complete search history.

(56) References Cited

U.S. PATENT DOCUMENTS

| | | | | |
|---|---|---|---|---|
| 4,836,280 | A * | 6/1989 | Soliman | 166/250.1 |
| 5,005,643 | A * | 4/1991 | Soliman et al. | 166/250.1 |
| 5,305,211 | A * | 4/1994 | Soliman | 702/12 |
| 6,076,046 | A * | 6/2000 | Vasudevan et al. | 702/12 |
| 6,659,175 | B2 * | 12/2003 | Malone et al. | 166/250.1 |
| 6,691,037 | B1 * | 2/2004 | Poe et al. | 702/13 |
| 7,111,681 | B2 * | 9/2006 | Detournay et al. | 166/250.1 |
| 7,114,567 | B2 * | 10/2006 | Chan et al. | 166/280.1 |
| 7,472,748 | B2 * | 1/2009 | Gdanski et al. | 166/250.1 |
| 2003/0054962 | A1 * | 3/2003 | England et al. | 507/117 |
| 2003/0196799 | A1 * | 10/2003 | Nguyen et al. | 166/250.12 |
| 2004/0016541 | A1 * | 1/2004 | Detournay et al. | 166/250.1 |
| 2004/0177965 | A1 * | 9/2004 | Harris et al. | 166/300 |
| 2007/0272407 | A1 * | 11/2007 | Lehman et al. | 166/250.1 |
| 2008/0133193 | A1 * | 6/2008 | Gdanski et al. | 703/10 |

FOREIGN PATENT DOCUMENTS

SU 1298376 A1 3/1987

OTHER PUBLICATIONS

Barree R.D., et al., A Practical Guide to Hydraulic Fracture Diagnostic Technologies, SPE Annual Technical Conference and Exhibition, San Antonio, Texas, Sep. 29-Oct. 2, 2002, SPE 77442, pp. 1-12.

Yentov V.M., et a. Hydraulic Fracture Cleaning Process Simulation, Current Problems of the State and Development of the Russian Oil and Gas Complex, Abstract of the Report of the 6th Scientific and Technical Conference Devoted to the 75th Anniversary of the Gubkin Russian State University of Oil and Gas , Jan. 26-27, 2005, pp. 400-401.

Cipolla, C.L. et al., State-of-the-Art in Hydraulic Fracture Diagnostics, SPE Asia Pacific Oil and Gas Conference and Exhibition, Brisbane, Australia, Oct. 2000, SPE 64434, pp. 1-15.

Pope D., et al., Field Study of Guar Removal from Hydraulic Fractures, SPE Internatinal Symposium on Formation Damage Control, Lafayette, LA, Feb. 1995, SPE 31094, pp. 239-245.

Yang., H.B., et al., Improved Flowback Analysis to Assess Polymer Damage, SPE Production Operations Symposium, Oklamoma City, OK, Mar. 1997,SPE 37444, pp. 485-496.

Willberg, D.M., et al., Determination of the Effect of Formation Water on Fracture Fluid Cleanup Through Field Testing in East Texas Cotton Valley, SPE Annual Technical Conference and Exhibition, San Antonio, TX, Oct. 1997, SPE 38620, pp. 531-543.

Willberg, D.M., et al., Optimization of Fracture Cleanup Using Flowback Analysis,SPE Rocky Mountain Regional Low-Permeability Reservoirs Symposium and Exhibition, Denver, CO, Apr. 1998, SPe 39920, pp. 1-13.

* cited by examiner

*Primary Examiner* — Angela M DiTrani

(57) ABSTRACT

A numerical model of a polymer-based fracturing fluid displacement from a fracture and a filtrate zone by a formation fluid is provided for calculating a change of a fracturing fluid concentration in a produced fluid and for calculating a change of a polymer concentration in the recovered fracturing fluid. Throughout the entire fracturing fluid recovery the produced fluid samples are periodically taken from a well mouth. The fracturing fluid concentration and the polymer concentration in the samples are measured. The measurement results are compared with the model calculations and the fracture length and width are determined based on a match of the measurement results and the model calculations.

3 Claims, 4 Drawing Sheets

METHOD FOR HYDRAULIC FRACTURE DIMENSIONS DETERMINATION

BACKGROUND OF THE INVENTION

The invention relates to hydraulic fracture monitoring methods and particularly relates to determining the dimensions of the fractures resulting from hydraulic fracturing of a formation and may be applied in oil and gas fields.

Formation hydraulic fracturing is a well-known method to stimulate hydrocarbons production from a well. During a formation fracturing job a highly viscous liquid (also known as a fracturing fluid) containing a proppant is injected into the formation in order to create a fracture in a production zone and fill the created fracture with the proppant. To ensure efficient use the fracture must be located inside the production zone and not protrude into the adjacent strata as well as have sufficient length and width. Therefore, a fracture dimensions determination is a critical stage to ensure fracture process optimization.

Currently a fracture geometry is determined using various technologies and methods. Best known are the methods (so-called fracturing imaging), ensuring assessment of spatial orientation of the fracture and its length during the fracturing job and are mostly based on localization of seismic events using passive acoustic emissions. This localization is ensured by the "cloud" of acoustic events, leading to a volume within which the fracture may be positioned. These acoustic emissions are microseisms resulting from either high pre-fracture stress concentration, or a decrease of the current stress around the fracture with the subsequent fracturing fluid flowing into the formation. At best these events are analyzed to obtain information about the source mechanism (energy, displacement field, stress drop, source dimensions etc.). Analyzing the results of these events, it is impossible to obtain direct quantitative information concerning the main fracture. Other methods are based on measuring the deformation of the earth using tiltmeters either from a surface or from a wellbore. All these methods are rather expensive due to the necessity of proper positioning of the sensors in an appropriate location with good mechanical coupling between the formation and measurement tools. Other methods ensure an approximate assessment of the fracture height based either on temperature variations or on the data obtained using isotopic tracers (tracer atoms). A review of the aforementioned imaging methods above is presented, e.g., in the following publication: Barree R. D., Fisher M. K. Woodroof R. A. (2002), "A practical Guide to Hydraulic Fracture Diagnostic Technologies", SPE, paper 77442, presented at Annual Technological Conference and Exhibition in San Antonio, Tex., Sep. 29-Oct. 2, 2002.

The closest prior art is a method for hydraulic fracture dimensions determination, described in the USSR Certificate of Authorship No. 1298376, 1987. This method provides for injection of a fracturing fluid under pressure into a well bore, enabling the said fluid to create fractures near the well and to penetrate into them and further through the fracture surfaces into a formation filtration zone around the fractures. Then fluid flow parameters are measured. A disadvantage of this method is the necessity to use additional equipment and complicated calculations.

The purpose of the claimed invention is the creation of a method for determination of the dimensions of a fracture resulting from hydraulic fracturing activities based on the analysis and simulation of the fracturing fluid pumping out after the fracturing.

BRIEF SUMMARY OF THE INVENTION

A numerical model of a fracturing fluid displacement from a fracture and a filtrate zone around the fracture by a formation fluid for a given set of formation parameters, fracturing data and predicted fracture dimensions is provided for calculating a recovered fracturing fluid concentration changes in a produced fluid during production after fracturing. After putting the well into production, throughout the entire period of a fracturing fluid recovery, produced fluid samples are taken periodically from a well mouth. A recovered fracturing fluid concentration in the samples is measured and then the measurement results are compared with the numerical simulation data and the fracture length is determined based on ensuring a match of the measurement results and model calculations.

During the numerical modeling, a polymer concentration change in the recovered fracturing fluid is also calculated as a function of time; additionally, a polymer concentration is determined in the samples and, by comparing the measurement results with the model calculations, a fracture width is determined.

The fracturing fluid may also contain a tracer which differentiates the fracturing fluid from a formation water in situations where a significant amount of the formation water is present in the total production after fracturing.

In accordance with this invention, the determination of fracture dimensions, namely—its length and width, is based on the results of the recovered fracturing fluid measurements analyzed on the basis of the fracture cleanup modeling. Fracture cleanup is a process of a fracturing fluid displacement (recovery) from a fracture and a filtrate zone around the fracture by a formation fluid. The analysis of a recovered fracturing fluid is the measurement of a recovered fracturing fluid concentration in a produced fluid as a function of time after the fracturing, and, in case of using a polymer fracturing fluid, a concentration of a polymer in the recovered fracturing fluid.

During a formation fracturing job a fracturing fluid filtrate (or aqueous base of the fracturing fluid, in case of using a polymer fracturing fluid) penetrates into the formation. Simultaneously, a polymer component of the fracturing fluid (in case of the polymer fracturing fluid) is trapped at the formation surface and stays within the crack fracture. When a well is put into production after the fracturing job, the fracturing fluid is displaced from the fracture and from a filtrate zone around the fracture by a formation fluid. Thus, at the beginning, the fractured well produces (recovers) the fracturing fluid that was originally pumped during the fracturing job.

Time behavior of a fracturing fluid concentration in a produced fluid is directly defined by the fracture and the filtrate zone cleanup process. A change of the ratio of the recovered fracturing fluid to the formation fluid in the produced fluid depends on the rate of the fracturing fluid filtrate displacement from the filtrate zone, and, consequently, on the rate of the formation fluid penetration into the fracture (through the filtrate zone) and coming out to the surface. The duration of the fracturing fluid filtrate displacement from the filtrate zone depends on the filtrate zone depth which, in turn, depends on the fracture length for a given volume of the injected fracturing fluid. Therefore, a change of the fracturing fluid concentration in the produced fluid at a given well yield depends on the fracture length. Thus, for the same total volume of the fracturing fluid filtrate in the filtrate zone the fracturing fluid concentration at the beginning of production decreases faster when the fracture length is longer.

In a case wherein a polymer fracturing fluid is used during a fracture cleanup process, the fracturing fluid filtrate coming from the filtrate zone also mixes with a polymer component inside the fracture. The change of a polymer (e.g., guar) concentration inside the fracture and, ultimately, in the recovered fracturing fluid, depends on the fracturing fluid filtrate inflow into the fracture and on the polymer mass in a certain location inside the fracture. On the one hand, the volume of the fracturing fluid filtrate coming from the filtration zone depends on a filtrate zone depth, and, consequently, on the fracture length. On the other hand, for the same polymer concentration inside the fracture the polymer distribution along the fracture length is proportional to the fracture width. Therefore, the change of the polymer concentration in the recovered fracturing fluid during the fracture cleanup depends both on the fracture length and width.

DETAILED DESCRIPTION OF THE INVENTION

Figure 1:
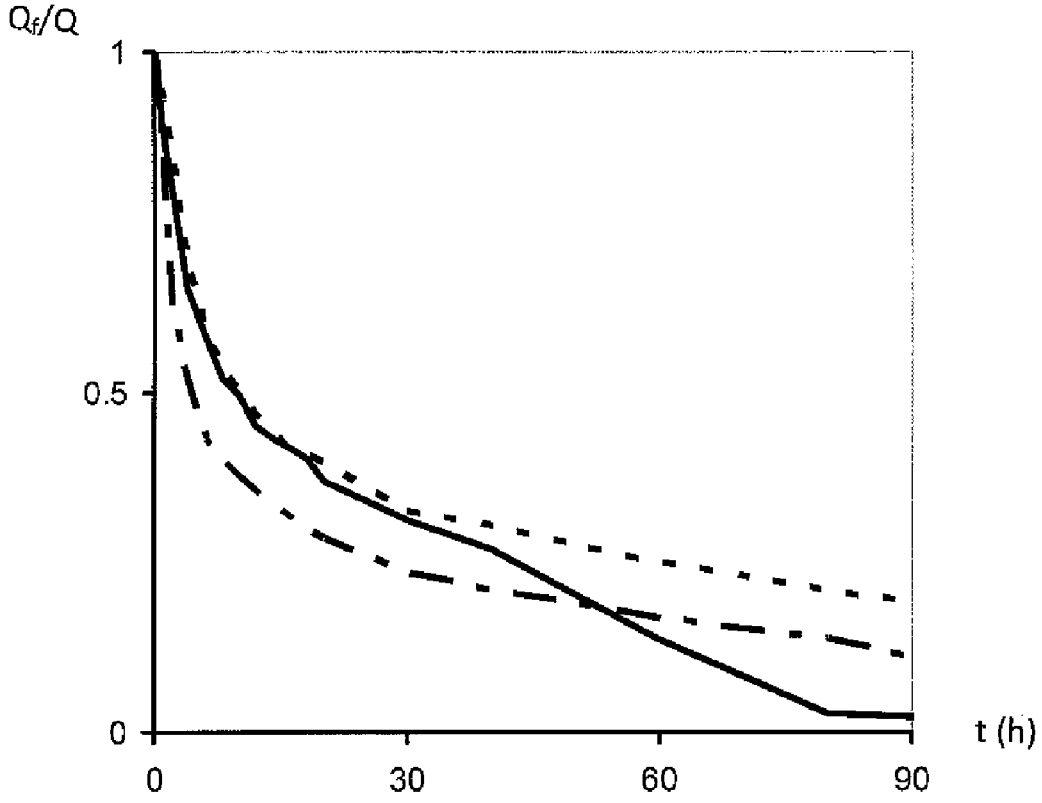
FIG. 1 shows the change of the ratio of a fracturing fluid recovery rate $Q_f$ to the total production rate Q (i.e. the water cut) as a function of time (time t on the x axis is shown in hours) for a typical formation fracturing job in Western Siberia. A solid line corresponds with the calculation for a fracture with the length of 150 meters and width 5 mm, a dotted line—for a fracture with the length of 150 meters and width 2.5 mm, a dotted-and-dashed—for a fracture with the length of 220 meters and width 5 mm.
Figure 2:
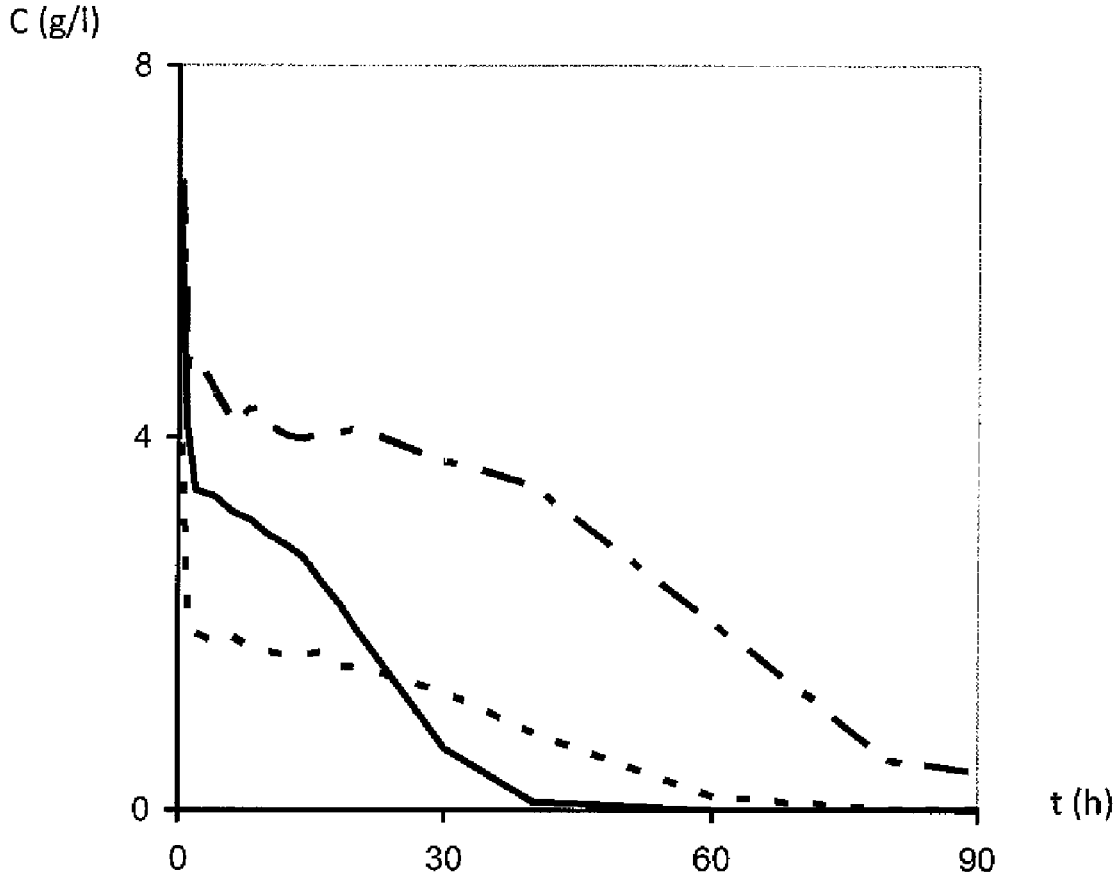
FIG. 2 shows the results of the calculation of the change of a polymer concentration C in the recovered fracturing fluid (in g/l) for the same dimensions as the fractures in FIG. 1 (time t on the x axis is shown in hours)

The claimed method for the determination of formation fracture dimensions is performed as follows. A fracturing fluid which is in general a water-based high-viscosity fluid is injected into a well bore. The fracturing fluid is pumped under a pressure sufficient to create a fracture in a bottom-hole area. During the fracturing job a fracturing fluid filtrate also penetrates into the formation around the fracture through a fracture surface. The fracturing fluid may also contain a tracer which provides for differentiation between the fracturing fluid and a formation water in situations where a significant amount of the formation water is present in the total production after the fracturing; the tracer may be represented by non-radioactive chemicals widely applied to assess water cross-flows (breakthroughs) between the wells.

In case of a polymer fracturing fluid, only a water base (filtrate) of the fracturing fluid penetrates into the formation, whereas, due to their large size, the polymer molecules cannot penetrate into the formation and remain inside the fracture. Therefore, when the fracturing fluid is being pumped out to the surface, the formerly pumped polymer stays inside the fracture and the fracture itself is surrounded by the fracturing fluid water base.

After the fracturing job, the well is put into production and samples of the fluid being produced are taken. Samples are taken near a well mouth using a method similar to the one usually applied to determine water cut. Samples are taken periodically throughout the entire period of the fracturing fluid recovery. For example, for typical post-fracturing well in Western Siberia the duration of the fracturing fluid recovery normally is 2-3 days, over this period product sampling is preferably made every 30 minutes during the first 7-10 hours, then—every hour throughout the remaining time. Then the samples are sent to a laboratory to measure the concentration of the recovered fracturing fluid in the produced fluid and the polymer concentration (for polymer fracturing fluids) in the recovered fracturing fluid.

In the laboratory the samples are processed in a centrifuge to separate the fracturing fluid from the oil, in the way similar to the standard water cut measurement. It enables to determine the fracturing fluid content change in the total production throughout the recovery period reviewed. If a polymer fracturing liquid was used, the fracturing fluid separated from the oil is analyzed to measure the polymer concentration. In case of using guar polymer the methodology is based on the known method applying phenol and sulfuric acid. As a result the time dependence of the polymer concentration change in the recovered fracturing fluid is obtained.

To assess fracture dimensions a numerical model of a fracturing fluid displacement from the fracture and the filtrate zone by a formation fluid is used (see, for example, Entov V. M., Turetskaya F. D., Maksimenko A. A, Skobeleva A. A. "Modeling of the Fracturing Crack Cleanup Process", Abstracts of the Reports of the $6^{th}$ Scientific and Practical Conference "Current Problems in the State and Development of Russian Oil and Gas Complex" dedicated to the $75^{th}$ Anniversary of Russian State Gubkin Oil and Gas University, Jan. 26-27, 2005, Section 6 "Automation, Modeling and Utility Supply for Oil and Gas Industry Processes", pp. 12-13).

The model calculates the change of the fracturing fluid concentration in the produced fluid, and, in case of using a polymer fracturing fluid, —change of the polymer concentration in the recovered fracturing fluid. The model input parameters look as follows:

1. The formation permeability and porosity, reservoir pressure, production interval height, formation oil viscosity.
2. Well yield or bottom-hole pressure during the fracturing fluid pumping out.
3. Total volume of the fracturing fluid, mass of the polymer and mass of the proppant pumped into the formation during the fracturing job, the proppant permeability and porosity, fracturing fluid viscosity.
4. Relative phase permeability values in the formation and in the pressed proppant in the fracture.
5. Predicted length and, in case of using a polymer fracturing fluid, predicted width of the fracture.

The parameters stated in 1-4 must be known from the formation properties, fracturing plan and data on the well productivity after the fracturing job. The fracture length and width are determined by comparing the results of the numerical modeling and laboratory measurements of the samples by means of making graphs, spreadsheets or computer calculations.

The fracture length and width must be selected upon the results of the approximation of two various data sets:

1) Changes in the fracturing fluid concentration in the total production obtained from numerical calculations and measured in a laboratory,
2) Changes in a polymer concentration obtained from numerical calculations and measured in a laboratory.

In case of the results non-alignment the predicted fracture dimensions are updated in such a way as to obtain the approximation of the results of the modeling calculations and measurements using, for example, least square method or any other mathematical quantitative method of approximation degree assessment.

Figure 3:
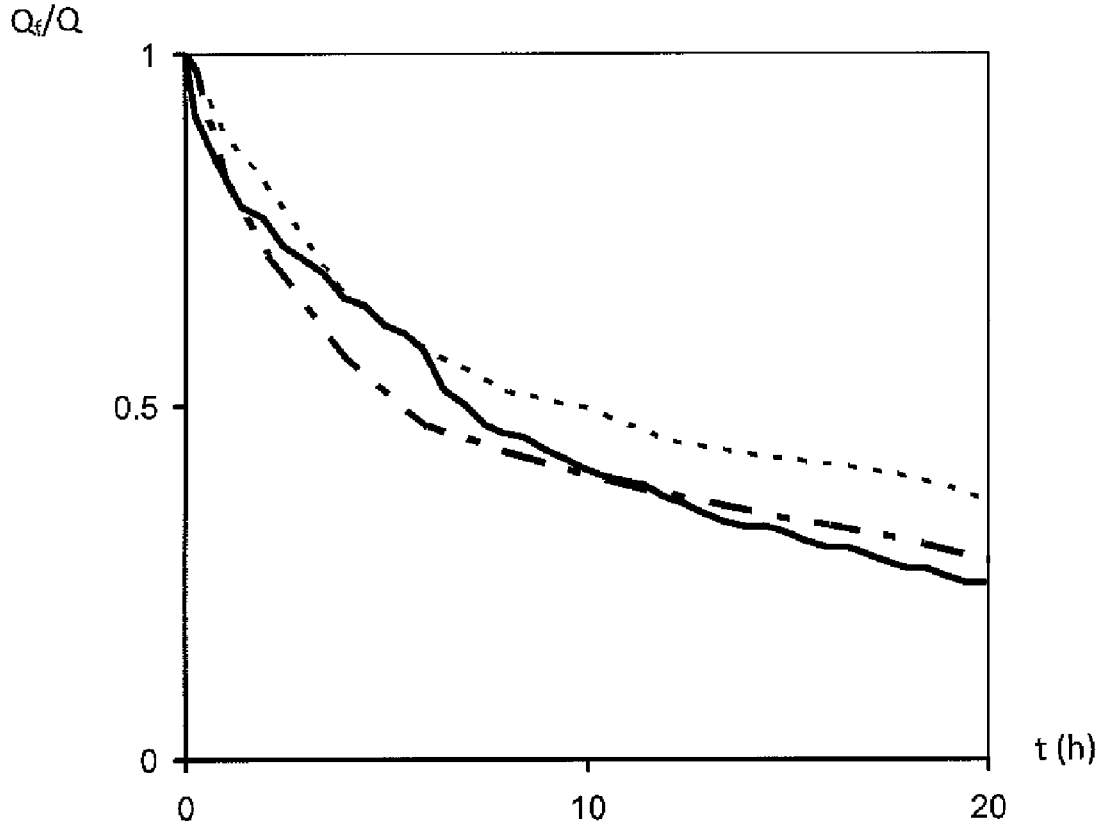
FIG. 3 shows the results of calculation and measurement of the change of ratio of the fracturing fluid recovery rate $Q_f$ to the total production rate Q as a function of time (time t on the x axis is shown in hours)
Figure 4:
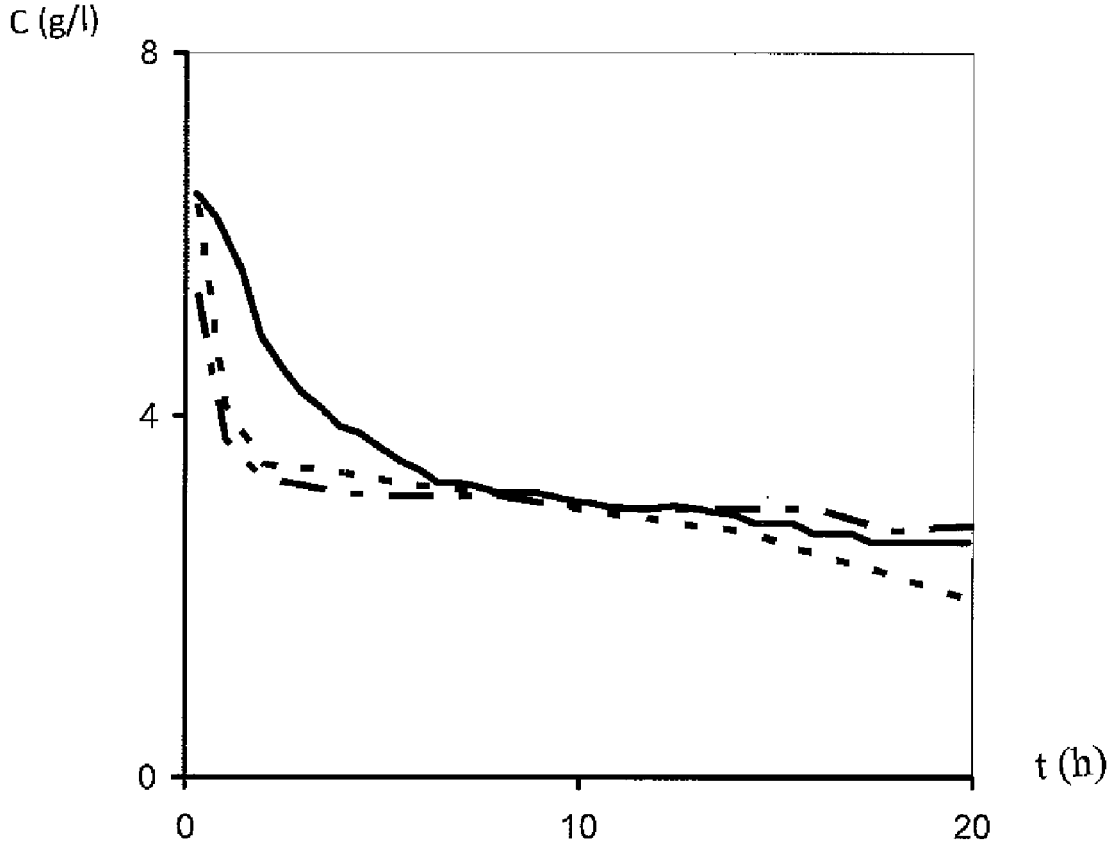
FIG. 4 shows the results of calculation and measurement of the change of a polymer concentration C in the recovered fracturing fluid (in g/l) (time t on the x axis is shown in hours).

To illustrate the method proposed an example of comparing the results of the recovered fluid analysis with the model calculation of the fracture cleanup process after the typical formation fracturing in Western Siberia is given as follows. The laboratory analysis of the recovered fracturing fluid includes measurements of the correlation of the fracturing fluid recovery rate and the total production rate (i.e. watercut) shown in FIG. 3 with a solid line and guar concentration (in g/l) in the recovered fracturing fluid, shown in FIG. 4 with a solid line. The results of modeling calculations of the fracture cleanup of the fracturing fluid when the fracture geometry is taken from the fracturing work design obtained using typical engineering software used to calculate the fracture growth during fracturing job, shown in FIGS. 3 and 4 with a dotted line. As we can see from FIGS. 3-4 (the difference between the solid and the dotted lines); the measured data and the modeling results do not match very well. To obtain a better match of the measurement results with the modeling calculations (see FIGS. 3-4, dotted-and-dashed line) the fracture geometry needs to be corrected as follows: the fracture length must be increased by about 40% and the width must be reduced by about 30%. Such a correction is well aligned with the constancy of the proppant mass inside the crack, i.e. the crack total volume remains unchanged. The modeled prediction results may be improved by using tracers that provide for differentiating the formation water from the fracturing fluid in case of the presence of a substantial amount of the formation water in the total production after the fracturing.

What is claimed is:

1. A method for determining hydraulic fracture dimensions comprising:

creating a fracture in a borehole zone by injecting a polymer-based fracturing fluid into a wellbore so that a fracturing fluid filtrate penetrates into a formation around the fracture through a fracture surface and creates a filtrate zone around the fracture, providing a numerical model for displacement of the fracturing fluid from the fracture and the filtrate zone, by a formation fluid, the model being made based upon given formation parameters, fracturing data, and predicted fracture dimensions, using the model for calculating a change of a recovered fracturing fluid concentration in a produced fluid during production as a function of time and for calculating a change of a polymer concentration in the recovered fracturing fluid as a function of time, putting the well into production, periodically taking fluid samples from a well mouth during a fracturing fluid recovery, measuring recovered fracturing fluid concentration and polymer concentration in the samples, comparing the measurement results with the model calculations; and determining fracture length and width on the basis of a match of the measurement results and the model calculations, the match being obtained by correcting the fracture length and width so as to provide a constant total fracture volume.

2. The method of claim 1 wherein the fracturing fluid contains a tracer to differentiate the fracturing fluid from a formation water.

3. The method of claim 1 wherein the polymer in the polymer-based fracturing fluid is guar.

* * * * *